US007651089B2

(12) United States Patent
Höpner et al.

(10) Patent No.: US 7,651,089 B2
(45) Date of Patent: Jan. 26, 2010

(54) METHOD AND DEVICE FOR FORMING STACKS OF FLAT ELEMENTS

(75) Inventors: Bernd Höpner, Augsburg (DE); Holger Kröger, Norderstedt (DE); Jochem Meyer, Hamburg (DE)

(73) Assignee: E.C.H. Will GmbH, Hamburg (DE)

( * ) Notice: Subject to any disclaimer, the term of this patent is extended or adjusted under 35 U.S.C. 154(b) by 0 days.

(21) Appl. No.: 11/812,511

(22) Filed: Jun. 19, 2007

(65) Prior Publication Data

US 2008/0006981 A1 Jan. 10, 2008

(30) Foreign Application Priority Data

Jun. 19, 2006 (DE) ..... 10 2006 028 381

(51) Int. Cl.
*B65H 31/12* (2006.01)
*B65H 29/00* (2006.01)

(52) U.S. Cl. ..... 271/218; 271/281

(58) Field of Classification Search ..... 271/218, 271/207, 213–215

See application file for complete search history.

(56) References Cited

U.S. PATENT DOCUMENTS 4,452,442 A * 6/1984 Geschwindner et al. ..... 271/204
4,478,403 A * 10/1984 Byrt ..... 271/189
4,796,879 A * 1/1989 Martini et al. ..... 271/218
4,842,573 A * 6/1989 Peter et al. ..... 493/412
5,074,743 A * 12/1991 Schaffner et al. ..... 414/790.8
5,110,112 A * 5/1992 Henn et al. ..... 271/189
5,407,189 A * 4/1995 Klenk ..... 271/218
5,433,429 A * 7/1995 Muller ..... 271/189
5,613,673 A * 3/1997 Roberts et al. ..... 271/182
5,713,283 A * 2/1998 Eltner et al. ..... 101/232
6,000,691 A * 12/1999 Chmelar ..... 271/158

(Continued)

FOREIGN PATENT DOCUMENTS

DE 28 08 774 9/1978

(Continued)

OTHER PUBLICATIONS

European Search Report mailed Nov. 23, 2007, issued in Application No. EP 07 01 1236.

*Primary Examiner*—Patrick H Mackey
*Assistant Examiner*—Patrick Cicchino
(74) *Attorney, Agent, or Firm*—Venable LLP; Robert Kinberg; Steven J. Schwarz

(57) ABSTRACT

A method and a device is provided for forming stacks of flat elements in a stacking region, the flat elements being guided to the stacking region substantially continuously. The flat elements are stacked on a main stack carrier. Upon achieving a finished stack of a predetermined number of flat elements stacked on the main stack carrier, an auxiliary stack carrier is inserted into the stacking region above the finished stack. Subsequent flat elements are then stacked on the auxiliary stack carrier. The finished stack is then removed from the main stack carrier and, subsequently, the main stack carrier is moved below the auxiliary stack carrier. The auxiliary stack carrier is then withdrawn from the stacking region, transferring the subsequent flat elements on the main stack. During or after this withdrawal process, at least an upper portion of the main stack carrier is moved substantially opposite the direction of withdrawal of the auxiliary stack carrier.

35 Claims, 16 Drawing Sheets

U.S. PATENT DOCUMENTS

| | | | | |
|---|---|---|---|---|
| 6,234,473 | B1 * | 5/2001 | Morgan et al. | 271/201 |
| 6,446,957 | B2 * | 9/2002 | Gunschera et al. | 271/218 |
| 6,481,952 | B2 * | 11/2002 | Deutschle et al. | 414/790.8 |
| 6,527,501 | B2 * | 3/2003 | Wolf | 414/789 |
| 2005/0269765 | A1 * | 12/2005 | Widmer et al. | 271/190 |

FOREIGN PATENT DOCUMENTS

| | | | |
|---|---|---|---|
| DE | 79 03 524 | | 6/1980 |
| DE | 33 00 329 | A1 | 7/1984 |
| DE | 36 12 019 | A1 | 10/1987 |
| DE | 39 22 803 | B4 | 1/1990 |
| DE | 199 28 367 | A1 | 12/2000 |
| DE | 199 43 800 | A1 | 3/2001 |
| DE | 10 2004 058 375 | A1 | 6/2006 |
| EP | 0 896 945 | B1 | 2/1999 |
| EP | 1 262 435 | A1 | 12/2002 |

* cited by examiner

METHOD AND DEVICE FOR FORMING STACKS OF FLAT ELEMENTS

CROSS-REFERENCE TO RELATED APPLICATION

This application claims the priority of German Patent Application No: 10 2006 028 381.3, filed on Jun. 19, 2006, the subject matter of which is incorporated herein by reference.

BACKGROUND

1. Field of Invention

The present invention relates generally to a device and method forming stacks of flat elements, and in particular to a device and method for forming stacks of sheets such as sheets of paper in a stacking region.

2. Description of the Related Art

Various methods and devices are conventionally used for stacking flat elements such as sheets of paper. The term "flat elements" refers, in particular, to individual sheets of paper, film, plastics material or the like having a two-dimensional shape. The terms "stack" and "partial stack" refer to accumulations of flat elements located one above another. The term "stacking region" refers to the place or region at which the (partial) stack is formed from the conveyed flat elements.

In the paper-processing industry, what are known as collecting stations are used to convey individual sheets, formed for example using a cutting means by cutting from a running web, continuously, i.e., without interruption, to a stacking region from which they are positioned one above another to form stacks. During this accumulation of sheets in the stacking region, the stacks having a defined predetermined number of sheets generally have to be conveyed away from the stacking region for further processing. However, to avoid disrupting the operation of the machine as a whole, sheets continue to be fed into the stacking region without interruption. Thus, during the transfer of a finished stack from the main stack carrier, an auxiliary stack carrier temporarily takes over the further stacking of the sheets in the stacking region until the main stack carrier is emptied and can once again take over the stacking of the sheets, at which point the partial stack formed in the auxiliary stack carrier is transferred to the main stack carrier. To accomplish this task, the auxiliary stack carrier is brought into the stacking region when the main stack carrier fills up and is removed when the main stack carrier returns.

The transfer of the partial stack from the auxiliary stack carrier withdrawing from the stacking region to the main stack carrier is critical. For as the auxiliary stack carrier has a specific thickness, a wave is formed in the lower portion of the partial stack at the moment at which the partial stack leaves the auxiliary stack carrier and is deposited on the main stack carrier. The formation of a wave of this type causes the lower region of the partial stack to be deposited misaligned and offset relative to the remaining portion of the partial stack located thereabove. This adverse effect can be further exacerbated by the friction produced between the upper side of the auxiliary stack carrier and the underside of the partial stack, as a result of which the lower layers of the partial stack are entrained during the withdrawal movement of the auxiliary stack carrier from the stacking region. If merely the main stack carrier performs a compensatory stroke movement in the vertical direction in order to compensate for the thickness of the auxiliary stack carrier, which has already been removed at that point from the stacking region, the offset of the lower region or the lower layers of the partial stack formed by the wave continues up to the end in the direction of the withdrawal movement of the auxiliary stack carrier. This creates a shoulder in the stack known as an S-bend, which often constitutes a quality defect. Particularly in the paper-processing industry, it is usually necessary to produce substantially straight stack edges in order not to impede the subsequent processing of the sheets, which is especially important in high-grade papers.

In an attempt to solve this problem, EP 1 262 435 A1 proposes a method and a device in which a second auxiliary stack carrier is provided in addition to a first auxiliary stack carrier. The second auxiliary stack carrier is arranged on the opposing side of the stacking region in relation to the first auxiliary stack carrier. Once the first auxiliary stack carrier has been introduced and the second auxiliary stack carrier has reached a position opposite the first auxiliary stack carrier, the second auxiliary stack carrier is moved, synchronously with the first auxiliary stack carrier, into a central position in the stacking region from which it is withdrawn from the stacking region in the opposite direction of the removal of the first auxiliary stack carrier. The partial stack formed on the second auxiliary stack carrier is then deposited on a pallet positioned on the main stack carrier located below the plane formed by the two auxiliary stack carriers. Although a respective wave is formed at the mutually facing ends of the two auxiliary stack carriers, these two waves are oriented away from each other and thus compensate for one another. Thus, the synchronous symmetrical removal of the two auxiliary stack carriers leads to depositing the partial stacks substantially without edge misalignment. However, in such a device, the arrangement of the second auxiliary stack carrier necessitates an expensive construction and a complex control means, which in turn leads to higher production, operating and maintenance costs.

EP 0 896 945 B1 proposes the use of a plurality of alignment strips and/or plates for the active rectangular alignment of the pallet and the stack of sheets located thereon in order in this way to compensate for deformation or edge misalignment in the stack. However, this known device is unsuitable for heavyweight stacks and large-format sheets. What is needed is a solution that is simple in terms of construction and control in comparison to the conventional devices discussed above, while at the same time allowing stacks to be exchanged continuously and without impairing the quality of the stacks.

SUMMARY

According to a first aspect of the invention, there is provided a method for forming stacks of flat elements, in particular sheets such as sheets of paper, in a stacking region, the flat elements being conveyed to the stacking region substantially continuously, the method including:

stacking a first plurality of flat elements on a main stack carrier; upon achieving a finished stack containing a predetermined number of flat elements stacked on the main stack carrier, inserting an auxiliary stack carrier into the stacking region, above the finished stack;

stacking a second plurality of flat elements on the auxiliary stack carrier;

removing the finished stack from the main stack carrier;

positioning the main stack carrier below the auxiliary stack carrier;

withdrawing the auxiliary stack carrier from the stacking region to transfer the second plurality of flat elements from the auxiliary stack carrier onto the main stack carrier; and during or after the withdrawing step, moving at least a portion of the main stack carrier comprising at least partially an upper side of the main stack carrier substantially horizontally relative to the second plurality of flat elements in a direction substantially opposite a direction of withdrawal movement of the auxiliary stack carrier during the withdrawing step.

According to a second aspect of the present invention, there is provided a device for forming stacks of flat elements, in particular sheets such as sheets of paper, in a stacking region, the flat elements being conveyed to the stacking region substantially continuously, the device comprising:

a main stack carrier arranged to receive a first plurality of flat elements thereon;

an auxiliary stack carrier arranged to be inserted into the stacking region upon achieving a finished stack containing a predetermined number of flat elements stacked on the main stack carrier in order to receive a second plurality of flat elements stacked thereon; and a control means adapted to control the movement of at least a portion of the main stack carrier comprising at least partially an upper side of the main stack carrier;

wherein the main stack carrier is further arranged to remove the finished stack from the stacking region and be positioned below the auxiliary stack carrier, and the auxiliary stack carrier is further arranged to be withdrawn from the stack region to transfer the second plurality of flat elements from the auxiliary stack carrier onto the main stack carrier; and wherein at least the portion of the main stack carrier comprising at least partially the upper side of the main stack carrier is adapted to be moveable substantially horizontally and the control means is adapted to control a movement at least the portion of the main stack carrier comprising at least partially the upper side of the main stack carrier substantially horizontally relative to the second plurality of flat elements in a direction substantially opposite a direction of withdrawal movement of the auxiliary stack carrier during of after the withdrawal of the auxiliary stack carrier.

The invention accordingly proposes configuring at least a portion of the main stack carrier at least partially forming the upper side so as to be movable in the direction of the movement of withdrawal of the auxiliary stack carrier and using a movement at least of this portion of the main stack carrier at least partially forming the upper side substantially in opposition to the movement of withdrawal of the auxiliary stack carrier for compensation for an S-bend or offset in the lower region of the partial stack. This movement of advancement according to the invention, forming a compensatory movement, pushes the front edge of the lower region of the partial stack so that it is again perpendicular below the remaining portion of the partial stack located thereabove, thus preventing or at least reducing to a minimum the formation of an S-bend or offset. As the size of the S-bend can be dependent on the material of the flat elements, the length thereof, the height of the partial stack, the geometry on withdrawal of the auxiliary stack carrier and other factors, the distance covered during the movement, substantially in opposition to the movement of withdrawal of the auxiliary stack carrier, at least of the portion of the main stack carrier at least partially forming the upper side should be individually adjustable and thus capable of being set.

Not least because the invention dispenses with the use of a further auxiliary stack carrier and other auxiliary means, the invention offers a solution which is simple in terms of construction and control but nevertheless effective.

Although, in the case of sheet feeders arranged in the run-in region of printing machines, the use of adjustment means for laterally positioning the upper layer of sheets of a stack of sheets transversely to the sheet conveying means is known, for example, from DE 28 08 774 A1, DE 79 03 524 U1 and DE 39 22 803 B4, these adjustment means move the main stack carrier or a movable platform arranged thereon so that the respective top sheet assumes a predetermined defined position from which it can be supplied to the printing machine. These conventional devices are thus different from a device according to embodiments of the present invention. In addition, it is crucial for the operation of these conventional devices to detect the lateral position of the top layer of sheets and to use the signal derived therefrom for activating the adjustment means. The solution according to the invention, on the other hand, does not require such positional detection. Furthermore, these conventional devices are unsuitable for a multi-purpose mode of operation and thus for the alignment of a complete stack. Finally, at no point does the prior art teach a core idea of the present invention, i.e., that of counteracting a positional misalignment to be expected in the lower region of a (partial) stack before it has even been produced.

Moreover, it is in principle also conceivable to have at least a portion of the auxiliary stack carrier at least partially forming the upper side, alternatively or additionally to the at least one portion of the main stack carrier at least partially forming the upper side, perform a movement substantially opposite to the withdrawal movement of the auxiliary stack carrier. A non-driven, peripheral cloth, for example, arranged on a portion of the auxiliary stack carrier may be suitable for this purpose.

According to an embodiment of the invention, the main stack carrier may have a deposit table which at least partially forms its upper side and moves relative to the remaining portion of the main stack carrier substantially in opposition to the movement of withdrawal of the main stack carrier.

In an alternative embodiment, the main stack carrier is provided with an endlessly circulating conveyor belt, the upper portion of which at least partially forms the upper side of the main stack carrier and moves substantially in opposition to the movement of withdrawal of the auxiliary stack carrier.

In yet another embodiment, the entire main stack carrier can also be adapted so as to be movable substantially in opposition to the movement of withdrawal of the auxiliary stack carrier.

According to an embodiment of the invention, expediently, the movement substantially opposite the withdrawal movement of the auxiliary stack carrier, at least of the portion of the main stack carrier that is at least partially forming the upper side, is initiated after the auxiliary stack carrier has performed its movement of withdrawal over a predetermined (i.e. predeterminable) distance. This allows the main stack carrier to prevent, among other things, the friction between the auxiliary stack carrier and the sheets from displacing the sheets by countering the movement of the auxiliary stack carrier.

According to one embodiment of the invention, a moving receiving element such as a pallet is positioned on the main stack carrier for receiving and for transporting the stack.

According to a further embodiment, at least the portion of the main stack carrier that is at least partially forming the upper side performs, in addition to its movement substantially in opposition to the movement of withdrawal of the auxiliary stack carrier, substantially simultaneously an upward movement so as to allow at least the thickness of the withdrawing or already withdrawn auxiliary stack carrier to be compensated for accordingly. For this purpose, it is conceivable for substantially the entire main stack carrier to perform this upward movement. According to one embodiment, this additional upward movement is carried out at least until the upper side of the main stack carrier or the upper side of the receiving element located on the main stack carrier reaches approximately the level of the upper side of the auxiliary stack carrier which by that stage has already been completely withdrawn.

According to an embodiment of the invention, there is provided at least one separating element, which may be a separating shoe, insertable into the stacking region. In this embodiment, at least the portion of the main stack carrier forming the upper side performs its movement substantially in opposition to the movement of withdrawal of the auxiliary stack carrier, while the separating element is still in the stacking region. In a further embodiment, this movement continues until the seperating has been removed from the stacking region.

According to an embodiment of the invention, a corresponding control means is provided for the above-described sequences of movements. The control means may control the upward movement substantially simultaneously with the movement substantially in opposition to the movement of withdrawal of the auxiliary stack carrier. For this purpose, a first drive means may be provided for the movement substantially in opposition to the movement of withdrawal of the auxiliary stack carrier and a second drive means may be provided for the upward movement, these two drive means being activated accordingly by the control means. In this development, it may be advantageous that the resultant path of movement is able to follow any desired adjustable curve. Alternatively, however, it is also conceivable for the control means to have at least one sliding guide for mechanically guiding at least the portion of the main stack carrier at least partially forming the upper side.

BRIEF DESCRIPTION OF THE DRAWINGS

An embodiment of the invention will be described hereinafter in greater detail with reference to the enclosed drawings, in which.

DETAILED DESCRIPTION

FIGS. 1 to 13 schematically illustrate thirteen schematic snapshots of operating states of a device according to an embodiment of the invention, carrying out the process of forming stacks of flat elements according to an embodiment of the invention.

Figure 1:
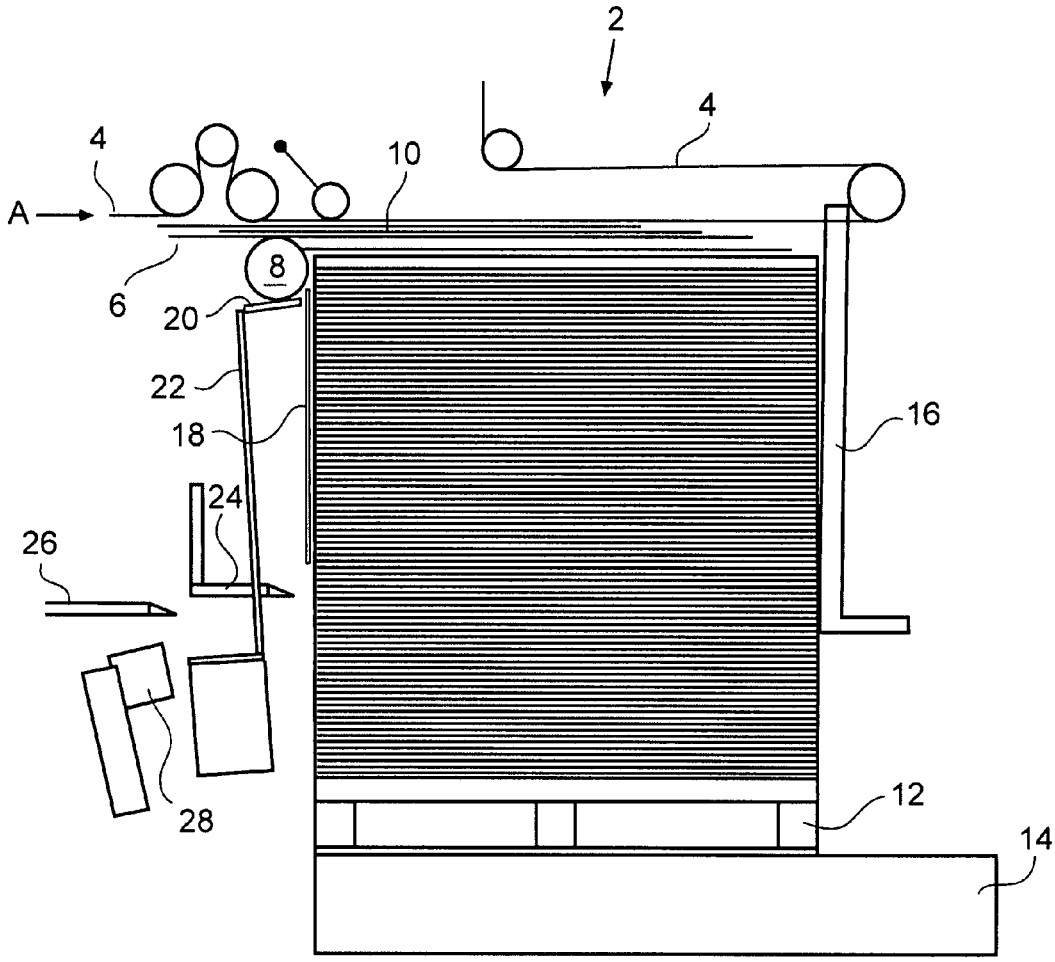
FIGS. 1-13 depict in sequence various operating states of a device according to an embodiment of the invention.

Referring now to FIG. 1, there is illustrated a device according to an embodiment of the invention which is used, in particular, for exchanging pallets for stacks of sheets, the sheets being conveyed substantially continuously to a stacking station 2. In the illustrated embodiment, the device has in the region of the stacking station 2 an upper belt 4 and on the run-in side, toward the stacking station 2, a plane of conveyance 6 and a transport roller 8. Between the upper belt 4, on the one hand, and the plane of conveyance 6 and the transport roller 8, on the other hand, sheets 10 are conveyed substantially continuously toward the stacking station 2 in the direction of arrow A. In an alternative embodiment, a lower belt extending ahead of the stacking station 2 may be provided instead of the plane of conveyance 6 and transport roller 8.

In the stacking station 2, the conveyed sheets 10 are piled up to form stacks on a pallet 12 resting on the upper side of a main stack platform 14. The main stack platform 14 is mounted so as to be moveable vertically in a manner not shown in greater detail in FIGS. 1 to 13.

A wall-type front preparer 16 is arranged at the end of the stacking station 2 to stop the sheets 10 conveyed to the stacking station 2 in the direction of conveyance A. Opposing the front preparer 16, the stacking station 2 is delimited by a wall-type rear preparer 18. Both the front preparer 16 and the rear preparer 18 are arranged vertically. The stacking station 2 is delimited horizontally by the aforementioned pallet 12 at the bottom.

During the stacking of the sheets 10, the main stack platform 14 carrying the pallet 12 is gradually lowered such that the upper side of the stack remains substantially at a constant level relative to the plane of conveyance (i.e., at the level of arrow A indicated in FIG. 1). To control the downward movement of the main stack platform 14, there is provided a control means which will be described in greater detail later in the description.

The rear preparer 18 has vertical recesses (not shown in the figures) through which a separating finger 20 is able to pass into the stacking station 2. The separating finger includes a plate arranged substantially in the horizontal direction, coupled to the upper end of an arm 22 which is arranged substantially in the vertical direction and is mounted to be pivotable.

In addition to the separating finger 20, there is also provided a separating shoe 24 arranged ahead of the stacking station 2 in the direction of conveyance A and adjacent to the rear preparer 18, which is mounted to be moveable in both the vertical and horizontal directions.

Although the figures show merely one separating finger 20 and one separating shoe 24, usually a plurality of separating fingers 20 and, in particular, a plurality of separating shoes 24 are used located next to one another in the direction transverse to the drawing plane of FIG. 1.

Arranged adjacent to the separating shoe 24 is an auxiliary stack platform 26 shown only at its end adjacent to the stacking station 2 in FIGS. 1-6 and 11-13 but in its entirety in FIGS. 7-10. The auxiliary stack platform 26 can be moved both in the vertical and in the horizontal directions. In the horizontal direction, the auxiliary stack platform 26 can be moved in the direction of conveyance A between a rest position outside the stacking station 2, as illustrated in FIG. 1, and a working position in which it has been completely introduced into the stacking station 2. Once the auxiliary stack platform 26 has been introduced into the stacking station 2, it is lowered vertically downward at a speed similar to that of the main stack platform 14, such that the upper side of the partial stack then formed on the auxiliary stack platform 26 remains substantially at a constant level relative to the plane of conveyance. The auxiliary stack platform 26 is moved vertically upward when it is in its rest position according to FIG. 1. This sequence of movements of the auxiliary stack platform 26 is also influenced by the aforementioned control means.

Finally, FIG. 1 clearly also shows a rear pallet preparer 28 which is mounted to be moveable in the direction of conveyance A between a rest position outside of the stacking station 2, as shown in FIG. 1, and a working position below the rear preparer 18, according to FIG. 7 to 11.

The movements of the separating finger 20, the separating shoe 24 and the pallet preparer 28 are also correspondingly controlled by the aforementioned control means. The same also applies to the drives (not shown in FIGS. 1 to 13) for the main stack platform and the drives (also not shown) for the auxiliary stack platform 26.

The operation of the device shown in FIG. 1 will be described hereinafter in greater detail with reference to FIG. 1 to 13, of which, for the sake of clarity, FIG. 2 to 13 include only the reference numerals of those components of significance to the method step respectively shown therein.

FIG. 1 shows the basic state of the device or the method. In this basic state, a predetermined number of sheets 10 are firstly stacked onto the pallet 12 of the stacking station 2, controlled by the control means previously discussed. This is carried out in that a continuous stream of sheets 10 is conveyed to the stacking station 2 counter to the front preparer 16. At the same time, the main stack platform 14 is lowered to leave the upper side of the slowly rising stack at a substantially constant level relative to the plane of conveyance. The separating finger 20, the separating shoe 24, the auxiliary stack platform 26 and the pallet preparer 28 are in this case each located in their rest position shown in FIG. 1.

Figure 2:
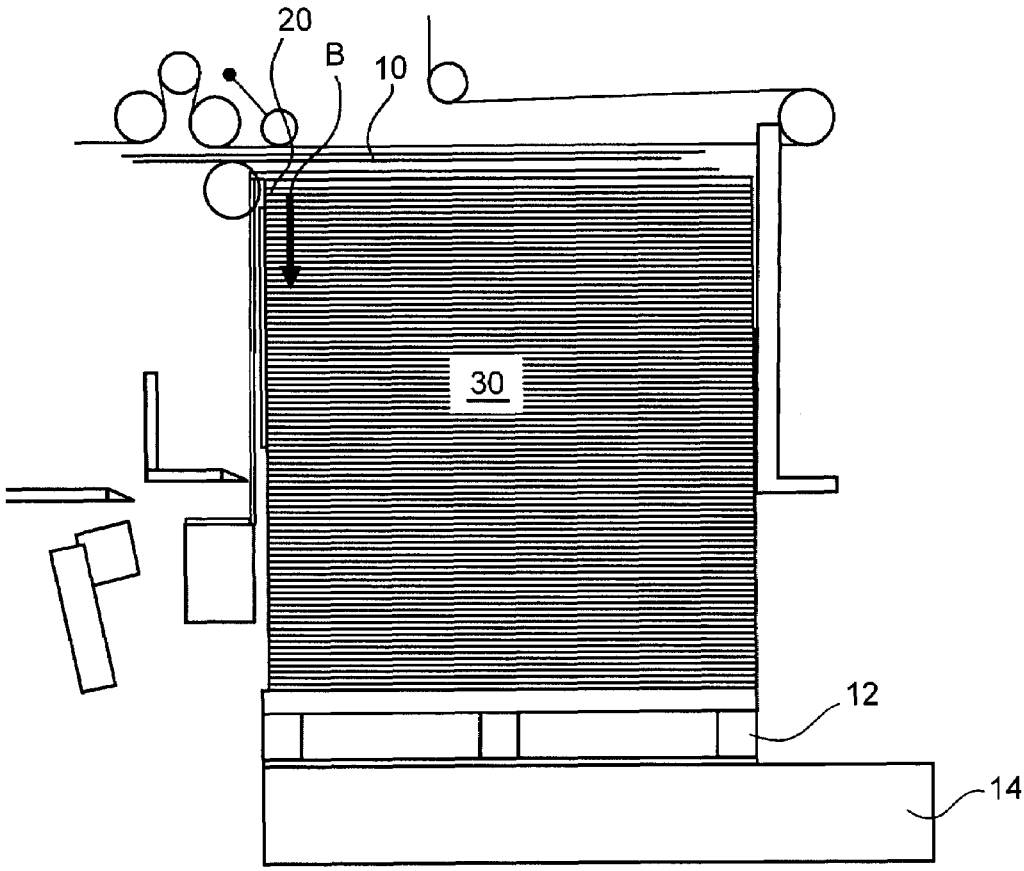

Once a sensor or counting means (not shown in FIGS. 1 to 13) has established that a specific number of sheets has been stacked up on the pallet 12 at the stacking station 2, the separating finger 20 is moved in the direction corresponding to the direction of conveyance A until it encompasses the finished stack of sheets 30 thus far formed, as shown in FIG. 2. Thus, according to FIG. 2, the separating finger 20 defines the upper limit of the finished stack of sheets 30, separating the following sheets 10 being continuously conveyed from the finished stack of sheets 30.

Figure 3:
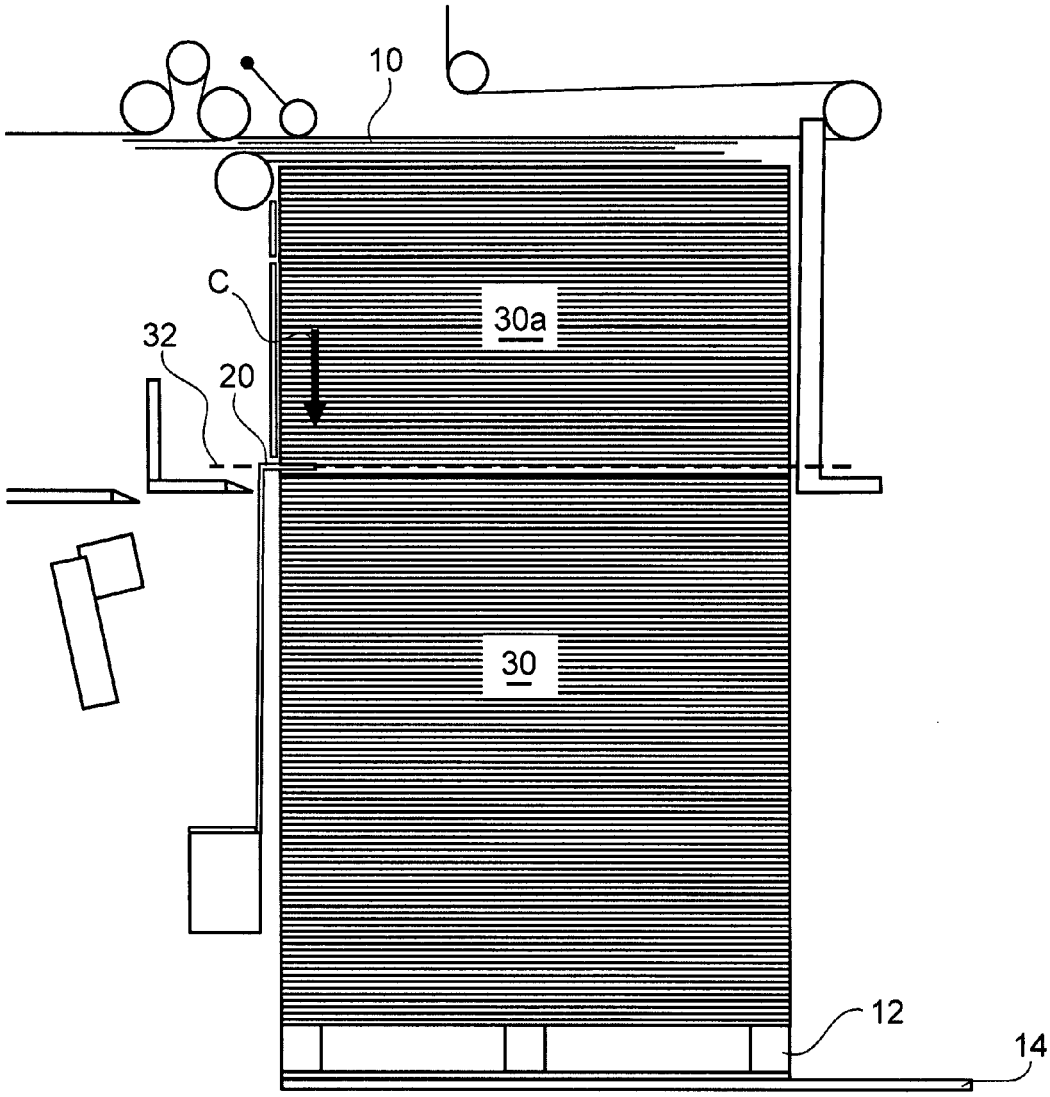

Referring now to FIGS. 2-3, as soon as the separating finger 20 has been introduced into the stacking station 2, the separating finger 20 is lowered in the direction of arrow B (FIG. 2) and arrow C (FIG. 3), synchronously with the main stack platform 14. As FIG. 3 also shows, a partial stack 30*a*, formed above the separating finger 20, rests on the finished stack of sheets 30 and gets thicker as more sheets 10 are conveyed onto the partial stack 30*a*. The inserted separating finger 20 defines a first virtual separating line 32 between the lower finished stack of sheets 30 and the partial stack 30*a* rising thereabove, as shown in FIG. 3.

Figure 4:
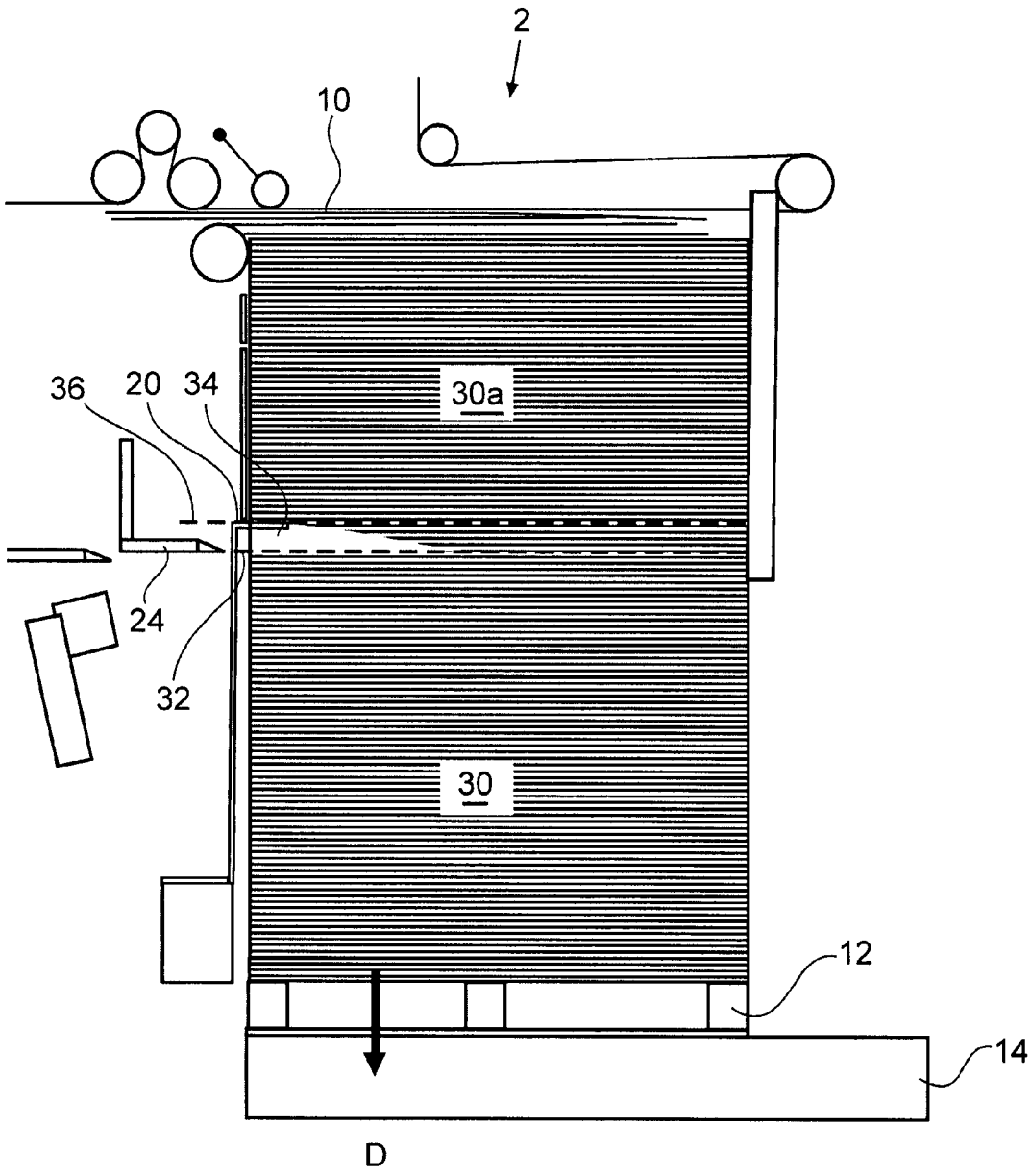

Referring now to FIG. 4, at this point the control means slows down the movement of the separating finger 20 so that the separating finger 20 is lowered more slowly than the main stack platform 14, which continues to move at in the direction of arrow D. As a result, a gap 34 is formed, as shown in FIG. 4, between the upper side of the finished stack 30, at the level of the first separating line 32, and the second virtual separating line 36, formed by the separating finger 20.

Figure 5:
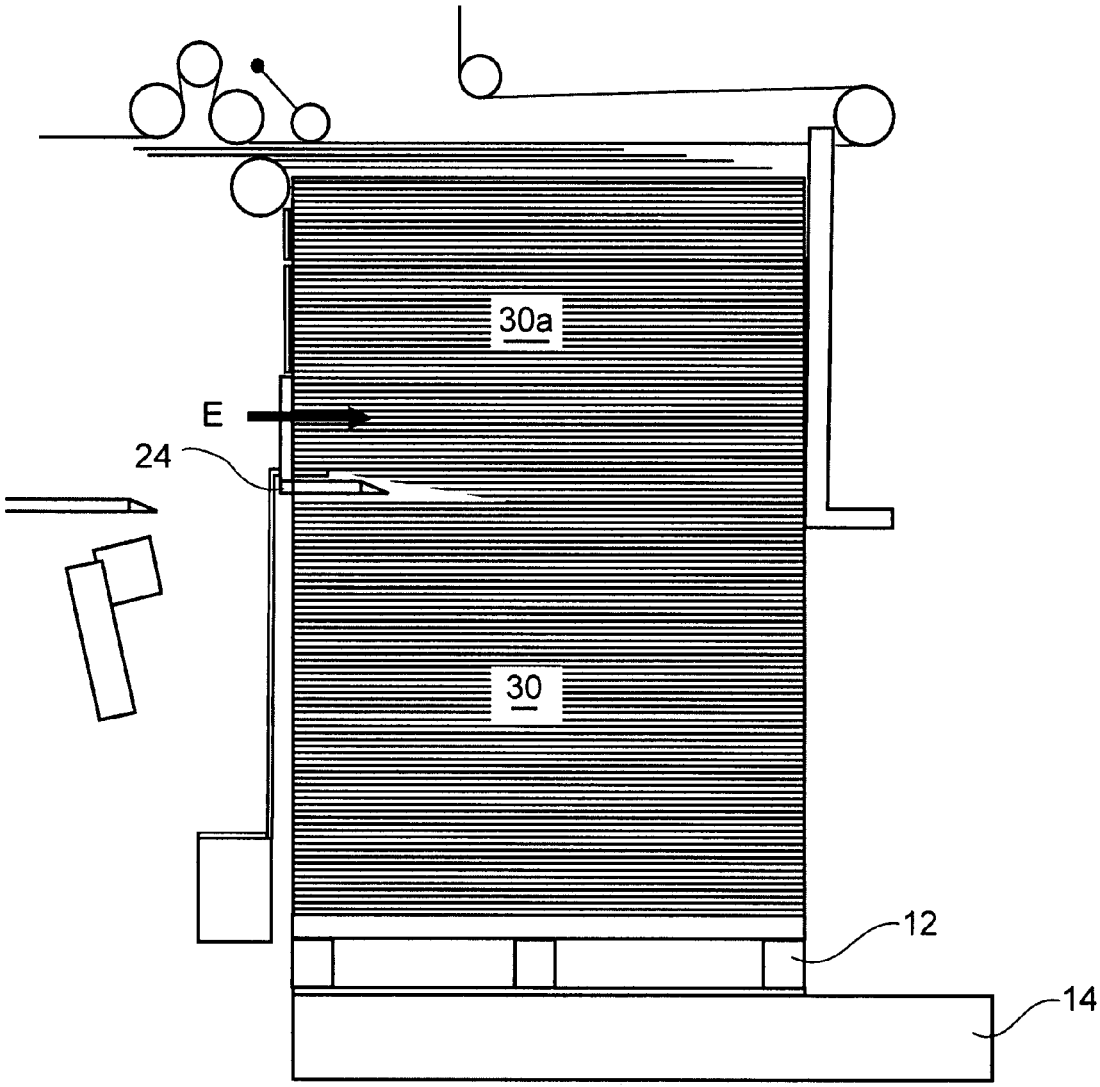

Referring now to FIG. 5, after the gap 34 is formed, the separating shoe 24 is then inserted in this gap 34 in the horizontal direction indicated by arrow E.

Figure 6:
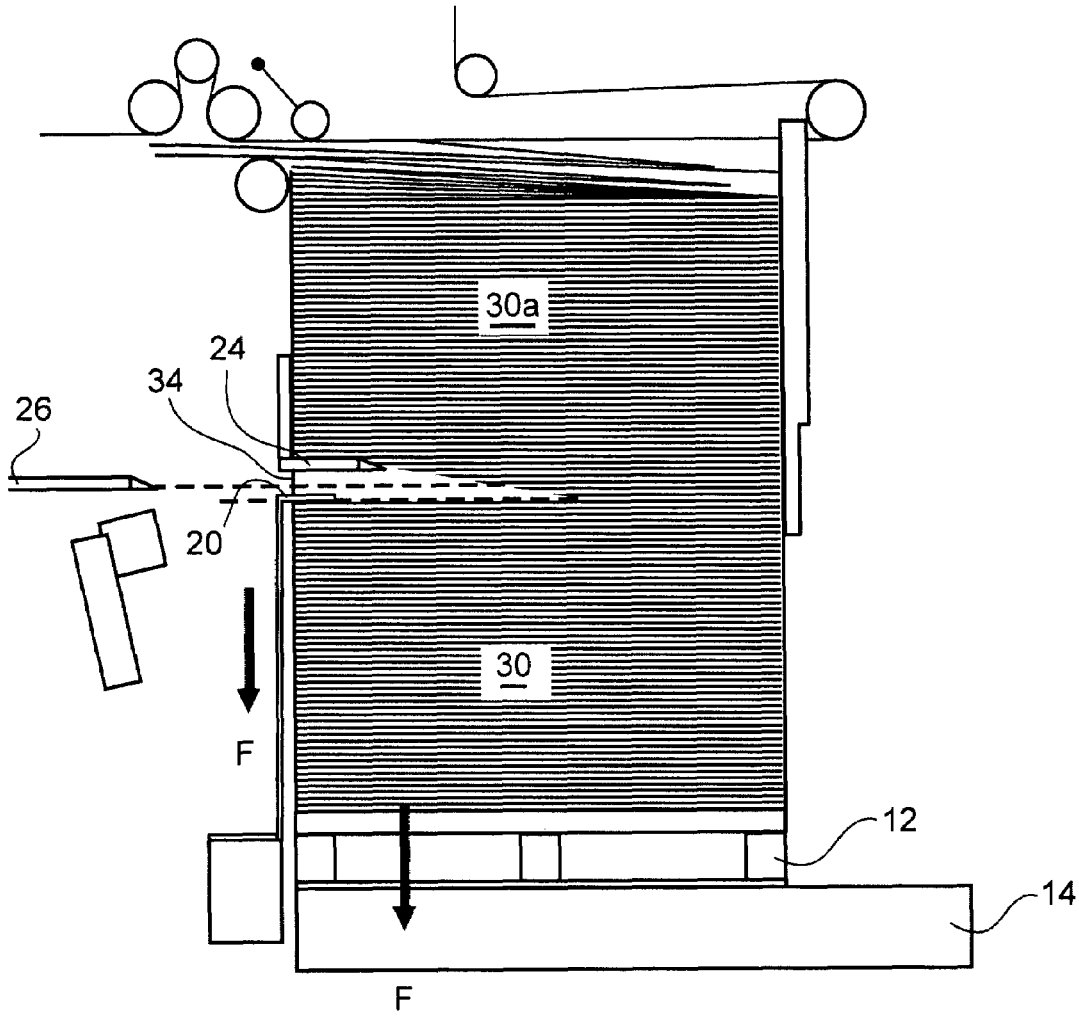

Referring to FIG. 6, during and after the insertion of the separating shoe 24, the separating finger 20 is lowered to once again surrounding the upper side of the finished stack 30, continuing to be lowered vertically at the same at the same speed as the main stack platform 14 in the direction of arrow F, thus enlarging the gap 34 as illustrated in FIG. 6.

Figure 7:
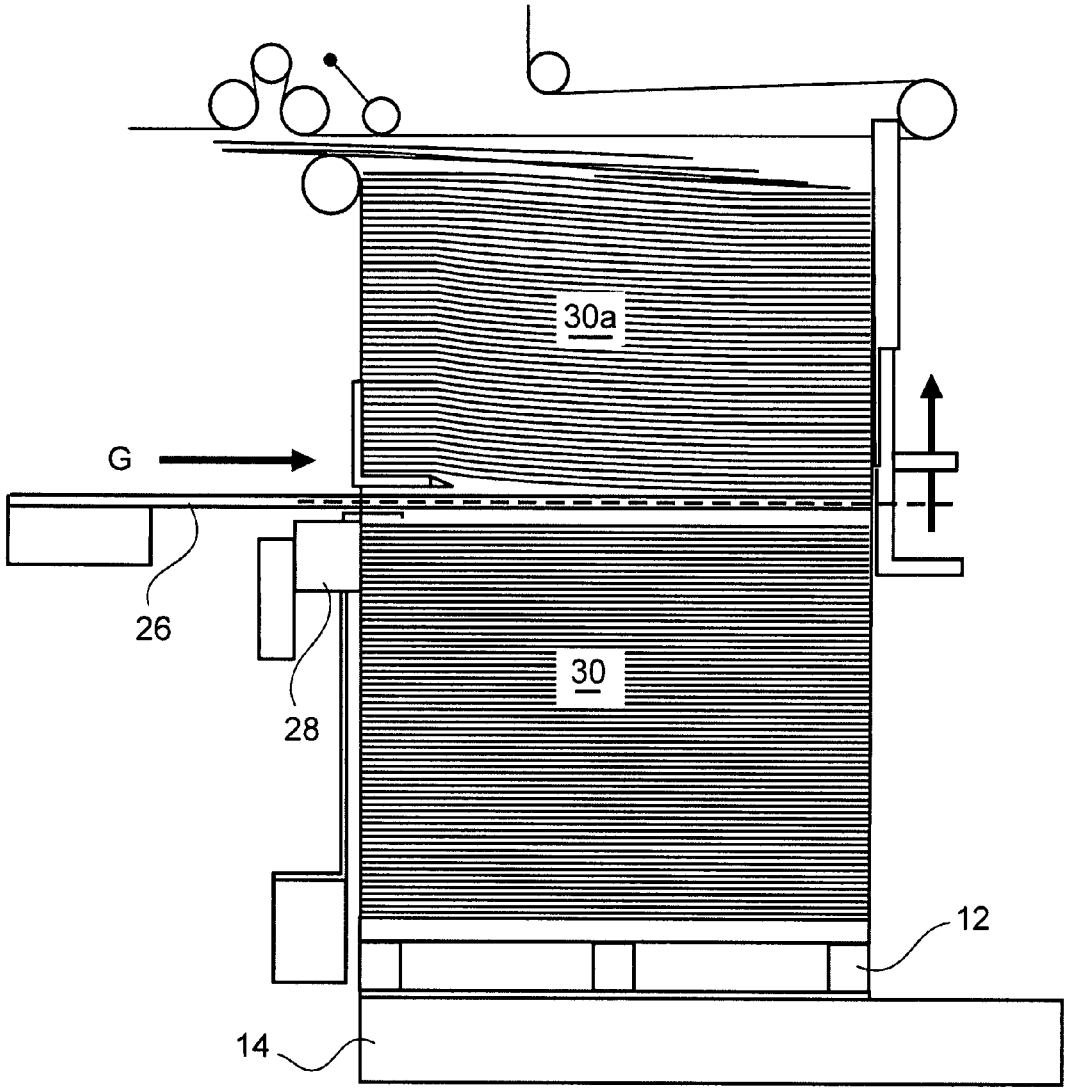

Referring now to FIG. 7, The auxiliary stack platform 26 is introduced into the enlarged gap 34 in the direction of arrow G, as a result of which the upper partial stack 30*a* comes to rest on the auxiliary stack platform 26 and the lower finished stack of sheets 30 is permanently separated from the partial stack 30*a* located thereabove. Furthermore, in this operating state, the pallet preparer 28 is moved into its working position in which it initially rests against the trailing side of the finished stack of sheets 30, as is also shown in FIG. 7.

Figure 8:
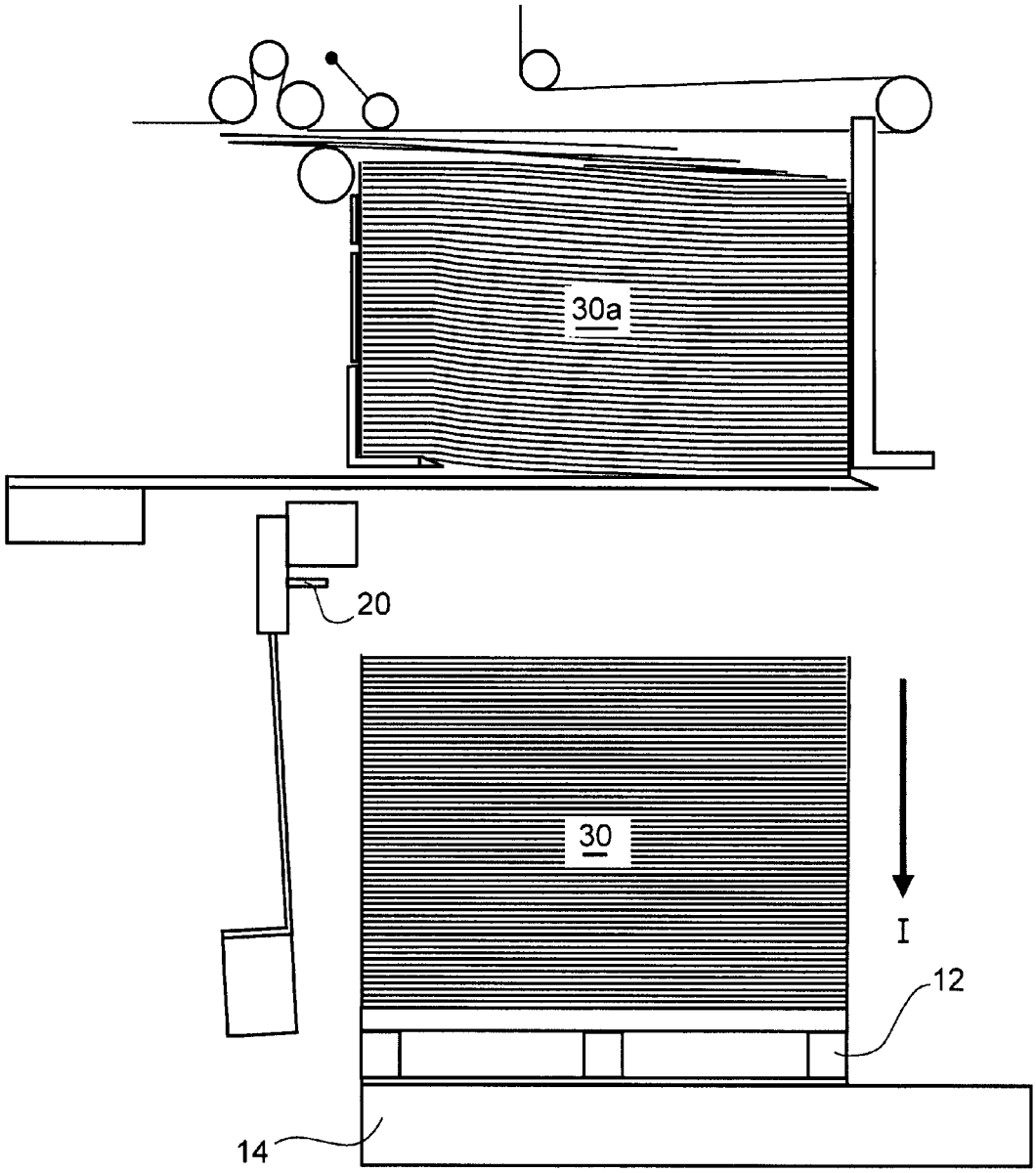

In the following step, as depicted in FIG. 8, the separating finger 20 is brought back into its rest position and the main stack platform 14 is moved downward in the direction of arrow I at a higher lowering speed.

Thereafter, the pallet 12, with the finished stack of sheets 30 located thereon, is removed from the main stack platform 14. To remove the main stack platform 14, a conveyor belt (not shown) may be provided on the main stack platform 14, the upper portion of which forms the upper side of the main stack platform 14 and, when rotated accordingly, pushes the pallet 12 resting thereon, along with the finished stack of sheets 30, from the main stack platform 14 to another conveying means. This conveyor belt, also referred to as a pallet conveyor, usually runs transversely to the direction of conveyance of the sheets 10 as indicated by arrow A in FIG. 1.

Figure 9:
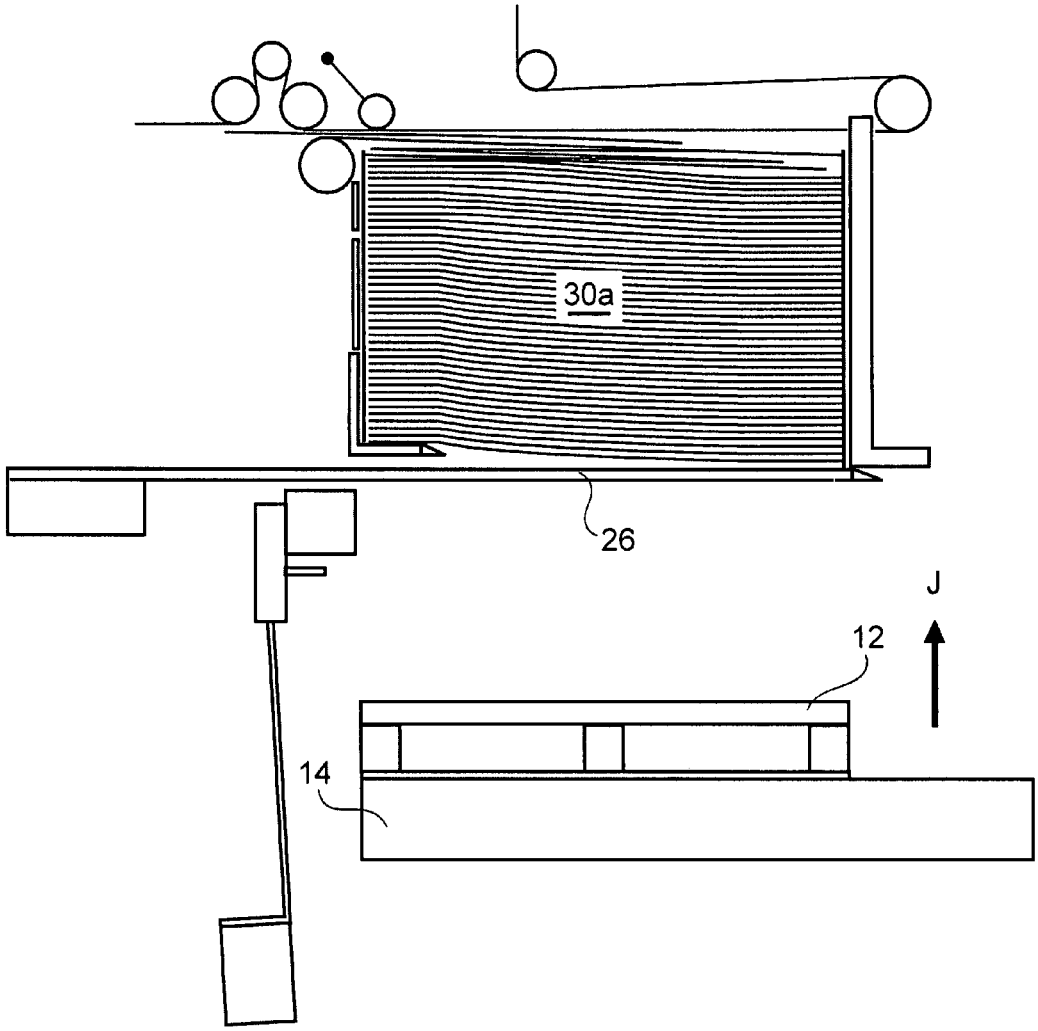
Figure 10:
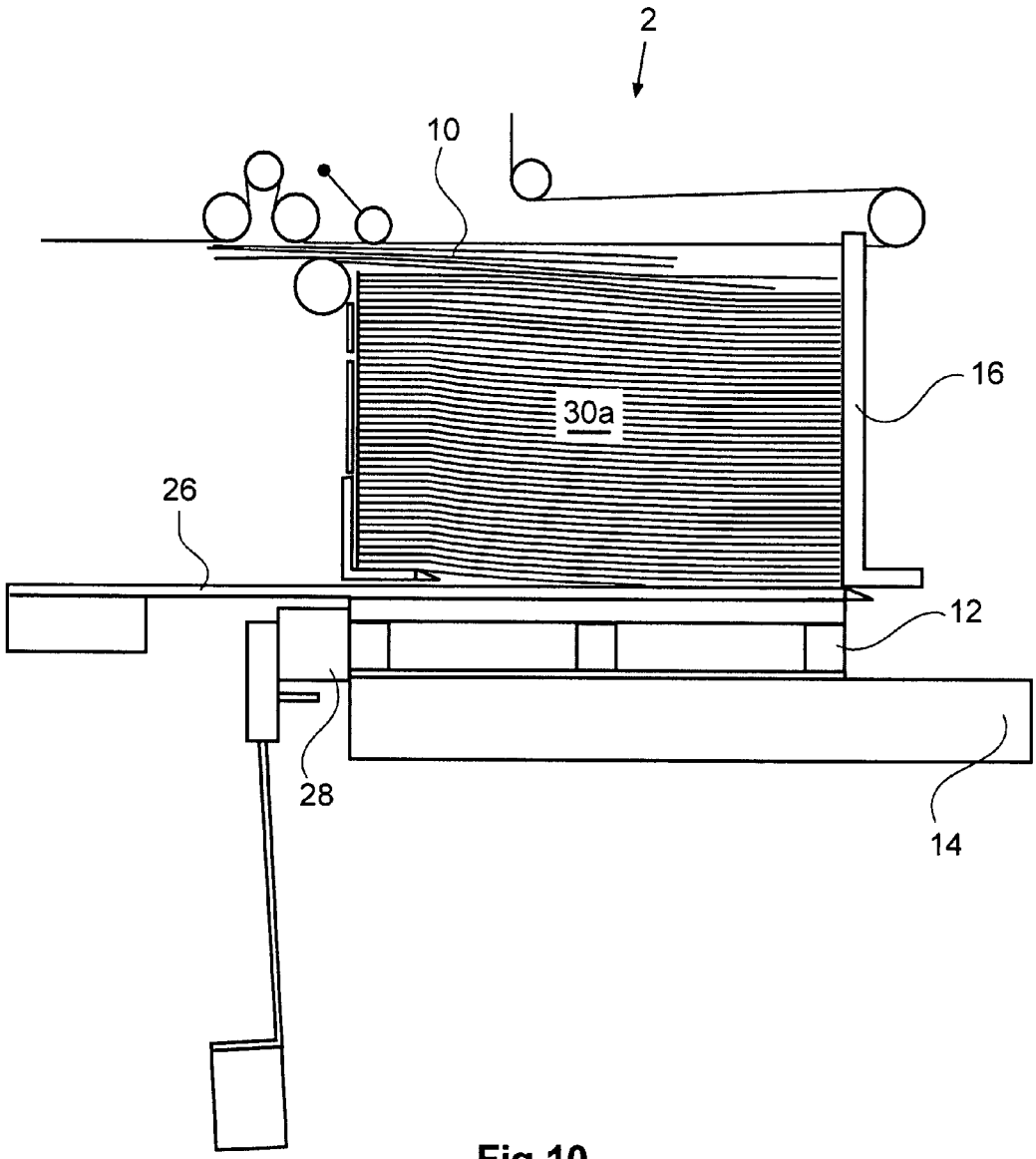

Referring now to FIGS. 9-10, once the pallet loaded with the finished stack of sheets 30 has been removed, a new empty pallet 12 passes onto the main stack platform 14. The main stack platform 14 is then raised vertically in the direction of arrow J (FIG. 9) until the main stack platform 14, including the empty pallet 12, passes into a position below the auxiliary stack platform 26 (FIG. 10). The pallet preparer 28, which is now in its working position, ensures a desired position of the pallet 12 relative to the partial stack 30*a*, which is still carried by the auxiliary stack platform 26 and continues to get larger as a result of the continuous supply of sheets 10.

As shown in FIG. 10, the rear edge portion of the partial stack 30*a* (opposite the front preparer 16) also still rests on the separating shoe 24, thus creating a small wave at the underside of the partial stack 30*a*. Therefore, in the region of the separating shoe 24, the partial stack 30*a* does not rest on the auxiliary stack platform 26 located below the separating shoe 24. As a result, only a part of the weight of the partial stack 30*a*, located near the front preparer 16, is borne by the auxiliary stack platform 26. This facilitates withdrawal of the auxiliary stack platform 26 from the stacking station 2 in the direction of arrow R according to FIG. 11, which illustrates the auxiliary stack platform 26 in its rest position after being fully withdrawn from the stacking station 2.

Figure 11:
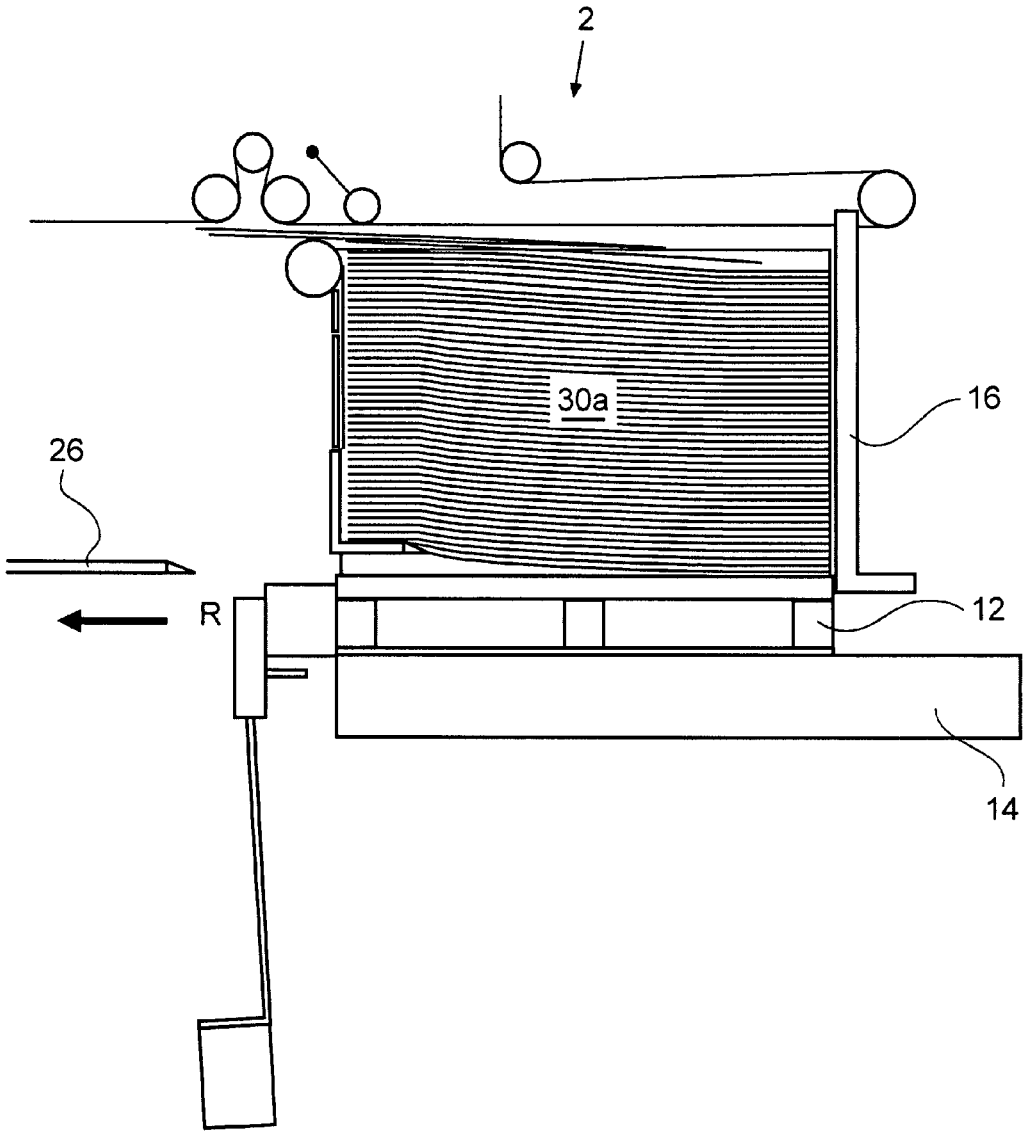

As the auxiliary stack platform 26 is withdrawn, the front portion of the partial stack 30*a*, adjacent to the front preparer 16, falls on the empty pallet 12 carried by the main stack platform 14. This initiates the transfer of the partial stack 30 to the pallet 12. This transfer is critical, because the auxiliary stack platform 26 has a specific thickness, causing the wave formed on the underside of the partial stack 30*a* to increase in size as the partial stack 30*a* is deposited from the withdrawing auxiliary stack platform 26 onto the pallet 12. As a result, the lower sheets of the partial stack 30*a* are not deposited on the pallet 12 adjacent to the front preparer 16, but rather are displaced slightly in the direction of movement of the auxiliary stack platform 26 away from the front preparer 16 in the direction of arrow R as shown in FIG. 11. This effect can be further intensified by the friction between the upper side of the auxiliary stack platform 26 and the underside of the partial stack 30*a*, but can be reduced or even ruled out by arranging or covering the auxiliary stack platform 26 with a non-driven, peripheral cloth.

Figure 12:
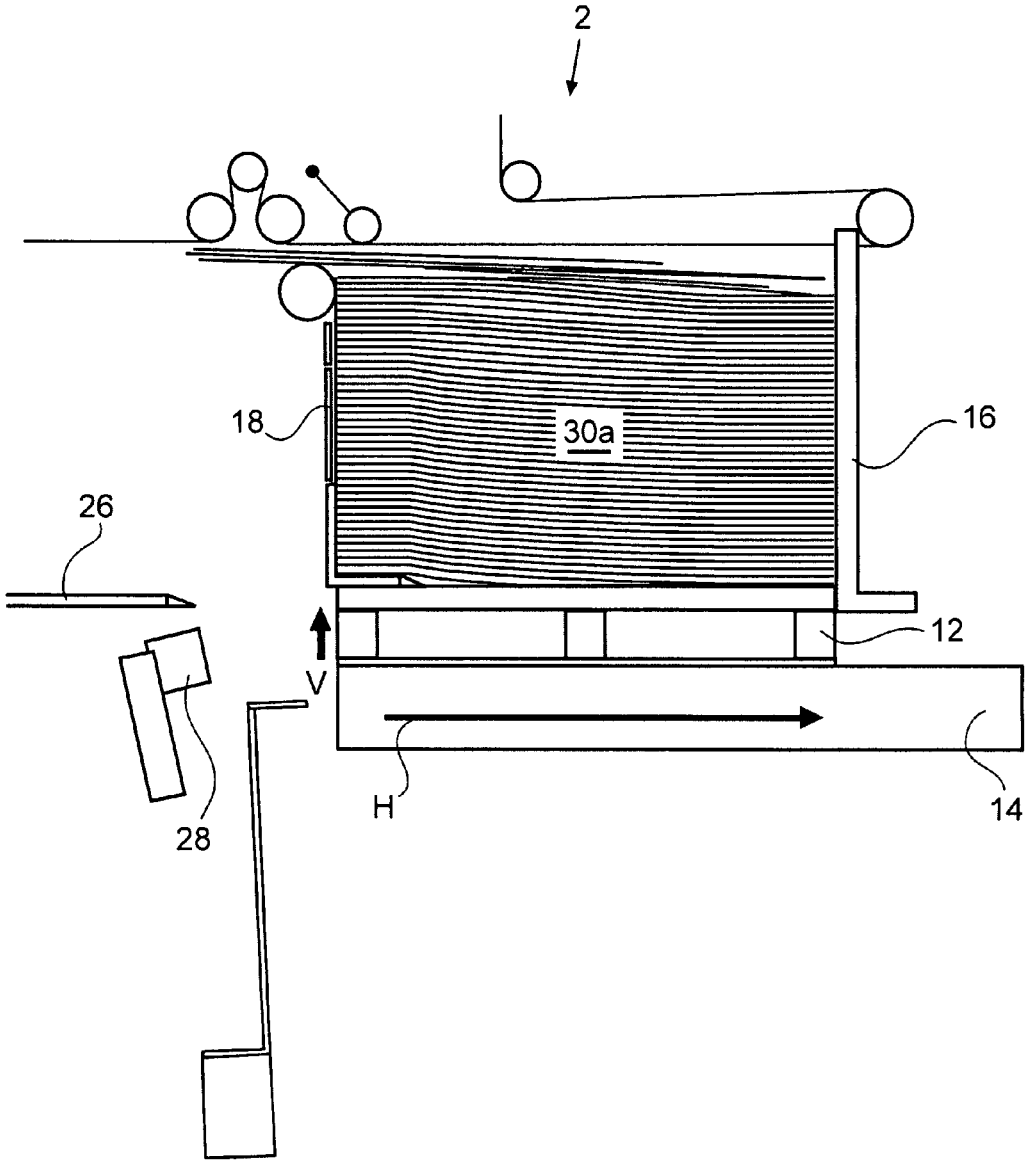

At this point the wave extends to the side of the partial stack 30*a* adjacent to the rear preparer 18. In order to compensate for the thickness of the auxiliary stack platform 26 which has already been removed, if the main stack platform 14 performs an upward stroke movement in the direction of arrow V as shown in FIG. 12, the lower layers of the partial stack 30*a* get pressed out below the rear preparer 18. This effect is further intensified as the separating shoe 24 is drawn from underneath the partial stack 30*a* and out of the stacking station 2 back into its rest position in the direction indicated by arrow I in FIG. 13. There may thus be formed in the lower region of the partial stack 30*a* a shoulder which is also referred to as an "S-bend" and constitutes a quality defect.

Figure 13:
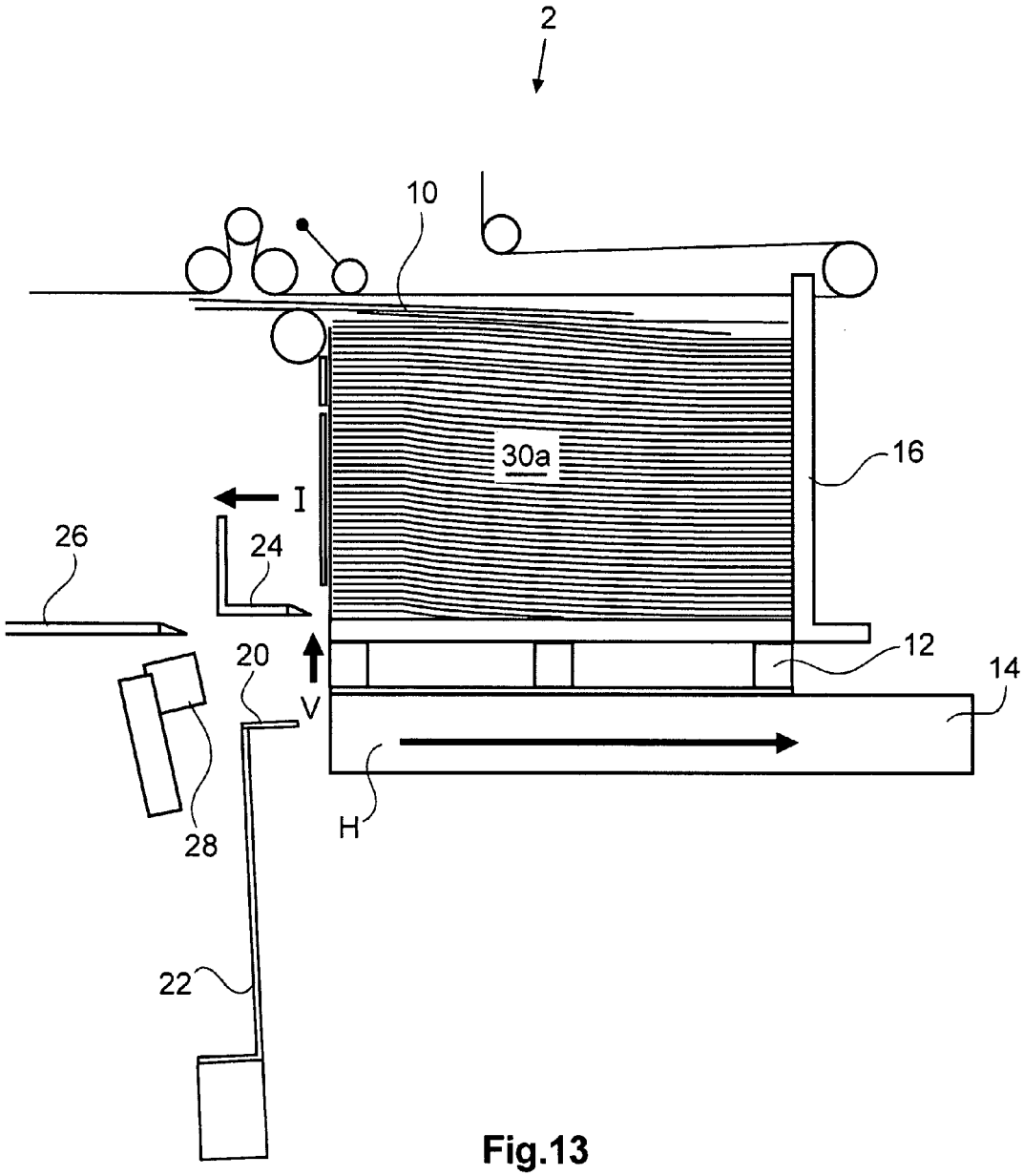

In order to avoid this adverse effect, according to an embodiment of the invention shown in FIG. 12, at the same time that the main stack platform 14 performs the above-mentioned vertical compensatory stroke in the direction indicated by arrow V, the main stack platform 14 is simultaneously subjected to a horizontal stroke in the direction of arrow H and thus in opposition to the movement R (FIG. 11) of the auxiliary stack platform 26 leaving the stacking station 2. This pushes the lower layers of the front edges of the partial stack 30 perpendicularly toward or below the front preparer 16. The distance conditioned by the above-mentioned wave in the vertical direction is compensated by this additional movement of horizontal advancement of the main stack platform 14 in the direction indicated by arrow H, thus allowing wave formation to be prevented or at least reduced to an acceptable minimum. The horizontal stroke movement indicated by arrow H is also carried out, for that matter, during the withdrawal of the separating shoe 24, as indicated in FIG. 13. As the size of the above-mentioned wave may be dependent on various factors such as the type of paper, the cutting length, the height of the partial stack 30*a* formed up until this point in time, the geometry during withdrawal from the auxiliary stack platform 26, etc., the extent of the horizontal stroke movement indicated by arrow H should be variable or adjustable. In one embodiment of the invention, the movement is carried out in a manner regulated by the addition of a suitable sensor means instead of the controlled manner. The horizontal movement indicated by arrow H is also synchronized with the vertical stroke indicated by arrow V. The synchronization of the horizontal and vertical movements may be linear or may follow any desired predetermined curve. The control means referred to at the outset also controls this sequence of movements.

Thereafter, as may also be seen from FIG. 12, the pallet preparer 28 has been moved back into its rest position outside the stacking station 2.

From here on, the process returns substantially to the same state as that shown in FIG. 1, although the arm 22, with the separating finger 20 positioned thereon, has still to be moved back into the upper rest position according to FIG. 1.

It should also be noted at this point that for the transfer of a subsequent partial stack 30*a*, the main stack platform 14 has first to be moved back in the horizontal direction over the length of the distance of horizontal advancement, now in the opposite direction, i.e., in the direction in opposition to arrow H of FIGS. 12 and 13 or in opposition to the direction of conveyance indicated by arrow A in FIG. 1. This backward-oriented horizontal movement is carried out while the main stack platform 14 loaded with a fully finished stack 30 is lowered during the method steps shown in FIGS. 7 and 8.

It should also be noted at this point that the method described hereinbefore with reference to FIG. 1 to 13 is usually carried out repeatedly.

Figure 14:
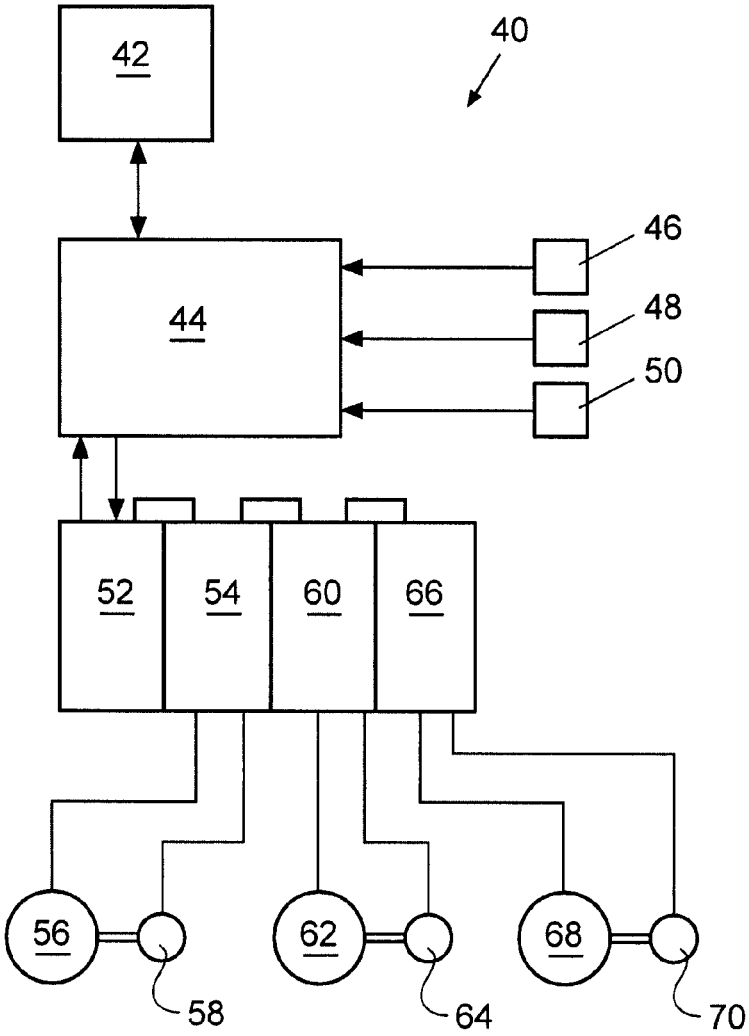
FIG. 14 illustrates a schematic block diagram of a control means having some basic components of the device shown in FIGS. 1-13, according to an embodiment of the invention.

Referring now to FIG. 14, there is depicted a schematic block diagram of a control and drive means 40 for controlling the method steps described with reference to FIGS. 1-13, according to an embodiment of the invention. As depicted in FIG. 14, there is accordingly provided an operating terminal 42 coupled to a machine control system 44. The machine control system 44 processes not only the data obtained from the operating terminal 42, but also data received from a laser light barrier 46, a rear edge sensor means 48, and a front edge sensor means 50. The laser light barrier 46 is used to count the sheets 10 or clips and is usually positioned at the run-in side of the stacking station 2, for example in the region of the transport roller 8 (FIG. 1). Counting the sheets 10 is important in order to establish when the formation of the stack 30 (FIG. 2) defined by a predetermined number of sheets 10 has been completed in order then to introduce the separating finger 20. The rear edge sensor means 48 and the front edge sensor means 50 are provided, inter alia, to detect the orientation of the lower layers of the partial stack 30*a* formed on the auxiliary stack platform 26 so as to allow the misalignment, resulting from the wave, between the front edges and the rear edges of the partial stack 30*a* to be calculated therefrom, as a result of which the requisite length of the path of horizontal advancement is then determined for the main stack platform 14 in the direction of arrow H in FIGS. 12 and 13. The rear edge sensor means 48 is therefore arranged in the plane of the rear preparer 18 and at the level of the auxiliary stack platform 26 and the front edge sensor means 50 is arranged in the plane of the front preparer 16 and also at the level of the auxiliary stack platform 26.

The machine control system 44 is coupled to a drive controller 52 containing a drive regulator 54 to which a lift drive motor 56 for the vertical movement of the main stack platform 14 and an associated position transmitter 58 are connected. The drive controller 52 also contains a drive regulator 60 to which a horizontal drive motor 62 for the movement of horizontal advancement of the main stack platform 14 and an associated position transmitter 64 are connected. FIG. 14 also schematically illustrates that the drive controller 52 contains a drive regulator 66 to which a horizontal drive motor 68 and an associated position transmitter 70 are also connected. The horizontal drive motor 68 is also used to generate the movement of horizontal advancement of the main stack platform 14. The use sketched in FIG. 14 of two horizontal drive motors 62 and 68 allows for an embodiment according to which, on two opposing sides, the main stack platform 14 is driven in the horizontal direction by a respective motor, the two horizontal drive motors 62 and 68 forming a common electrical wave, for which allowance must be made using a corresponding control means in the drive controller 52.

Not shown in the block diagram of FIG. 14 are control and drive means for the remaining components of the device shown in FIG. 1 to 13 such as, for example, for the separating finger 20, the separating shoe 24, the auxiliary stack platform 26 and the pallet preparer 28, which may be provided as separate components.

Figure 15:
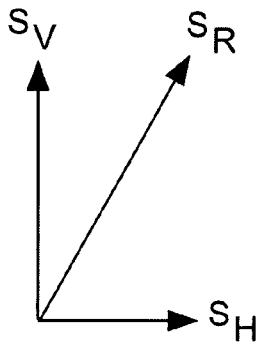
FIG. 15 is a vector diagram for illustrating the sequence of movement of the main stack platform of the device according to FIGS. 12 and 13.

As described with reference to FIGS. 12 and 13, for transferring the partial stack 30*a*, the main stack platform 14 performs in synchronization a vertical stroke movement in the direction V as well as a horizontal stroke movement in the direction H, resulting in a correspondingly obliquely upwardly oriented movement. This relation is depicted schematically with reference to a vector diagram illustrated in FIG. 15. As this diagram indicates, the resultant movement SR is formed from a combinatory effect of a vertical movement vector SV (corresponding to arrow V in FIGS. 12 and 13) and a horizontal movement vector SH (corresponding to arrow H in FIGS. 12 and 13). Corresponding activation of the associated drives 56, 62 and 68 in the control and drive means 40 of FIG. 14 allows the movement vectors SV and SH to be varied as a function of location, as a result of which the main stack platform 14 can, for example, perform a curved movement.

Figure 16:
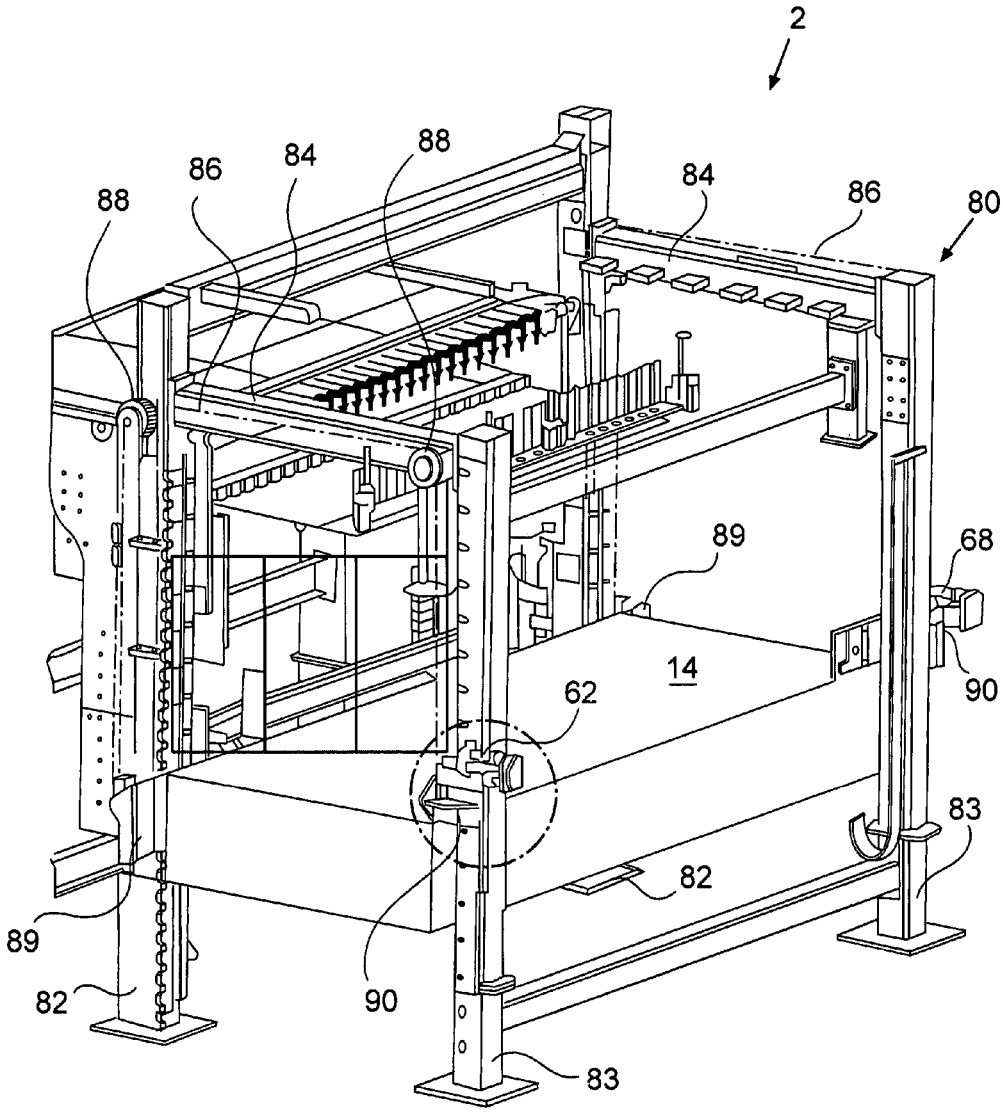
FIG. 16 is a perspective view of the stacking rack of the device having a few basic components according to an embodiment of the invention.

Referring now to FIG. 16, there is depicted a more detailed perspective view of the device discussed hereinbefore with reference to FIGS. 1 to 13, in the region of the stacking station 2, according to an embodiment of the present invention. As shown in the device of FIG. 16, a four-legged frame 80 is seen including two vertical stands 82 on the run-in side and two opposing stands 83, all stands 82, 83 being joined together by an upper longitudinal beam 84. A main stack platform 14 is suspended from the frame 80 via a chain drive ensuring the vertical movement of the main stack platform 14. FIG. 16 shows merely dot/dash lines 86 of the chain draw, illustrating the path of the chains and two chain wheels 88 on which the chains are deflected. The chains are jointly guided to a drive (not shown in FIG. 16), which is the lift drive motor 56 depicted in FIG. 14.

The main stack platform 14 is guided using carriages 89, 90 on the vertical rails arranged on the stands 82, 83. These carriages 89, 90 are adapted to allow horizontal movement in the direction of arrow H in FIGS. 12 and 13. The carriages 90 are each provided with a drive generating the above-described movement of horizontal advancement of the main stack platform, which are the horizontal drive motors 62 and 68 illustrated schematically in FIG. 14.

Figure 17:
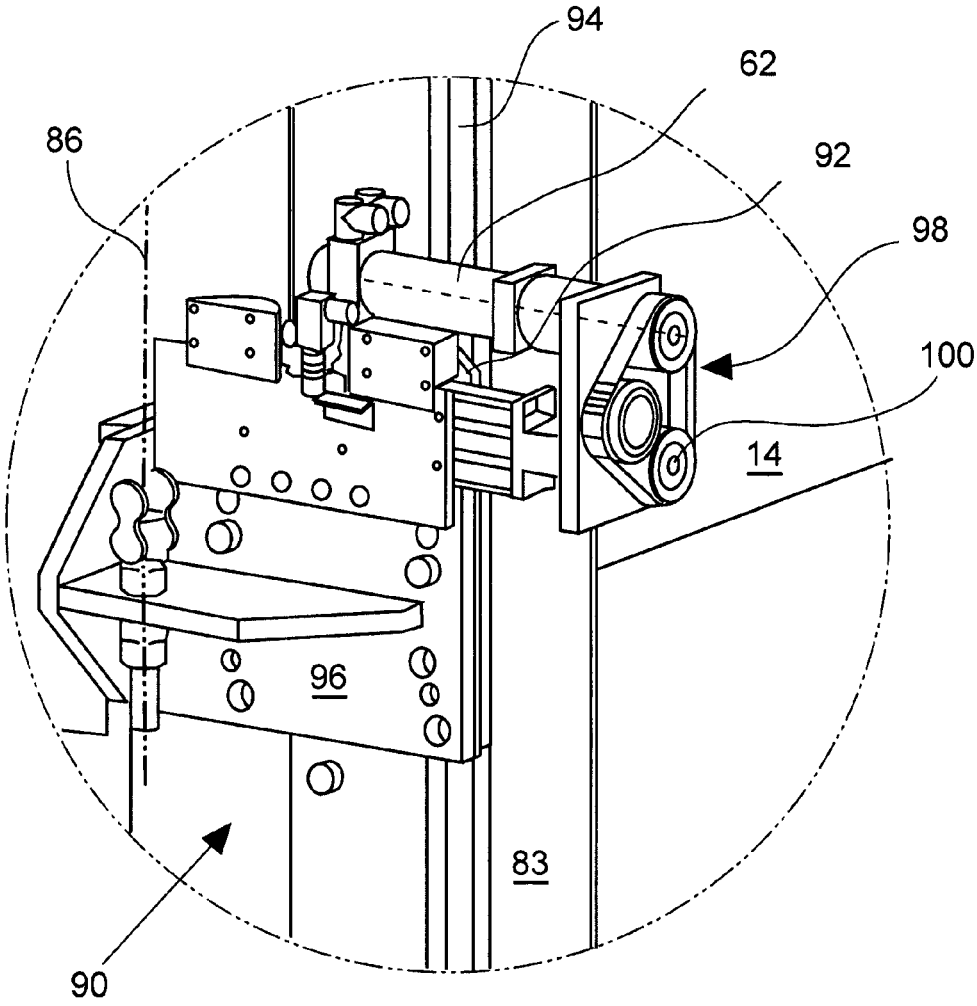
FIG. 17 is an enlarged view of a section of the stacking rack shown in FIG. 16.

FIG. 17 illustrates an enlarged view of the construction and the arrangement of one of the two carriages 90 depicted in FIG. 16, according to an embodiment of the invention. The carriage 90 has rolls 92 (only part of which is depicted in FIG. 17), which travel in a vertical rail 94 arranged on the stand 83. The carriage 90 also includes a carrier 96, which is fastened to the main stack platform 14 on one side and to a chain 86 of the chain drive (shown in FIG. 17 merely by dot/dash lines) on the other side. Also supported on the carrier 96 is the horizontal drive motor 62, the output shaft of which drives a spindle 100 mounted horizontally via a synchronous belt transmission mechanism 98, thus forming a linear drive generating the horizontal stroke movement of the main stack platform 14 relative to the stand 83. Adjustment is thus also carried out relative to the rolls 92 which are mounted on an element (not shown) on which there is a nut arranged non-rotationally (also not shown) through which the spindle 100 is guided.

It will be understood that the above description of the present invention is susceptible to various modifications, changes and adaptations, and the same are intended to be comprehended within the meaning and range of equivalents of the appended claim.

What is claimed is:

1. A method for forming stacks of flat elements in a stacking region, the flat elements being conveyed to the stacking region substantially continuously, the method comprising:

stacking a first plurality of flat elements on an upper side of a main stack carrier;

upon achieving a finished stack containing a predetermined number of flat elements stacked on the upper side of the main stack carrier, inserting an auxiliary stack carrier into the stacking region, above the finished stack;

stacking a second plurality of flat elements on the auxiliary stack carrier;

removing the finished stack from the main stack carrier;

positioning the main stack carrier below the auxiliary stack carrier;

withdrawing the auxiliary stack carrier from the stacking region in a withdrawing direction to transfer the second plurality of flat elements from the auxiliary stack carrier onto the main stack carrier; and during the withdrawing step, moving at least a portion of the upper side of the main stack carrier in a substantially horizontal advancement direction that is substantially opposite to the withdrawing direction of the auxiliary stack carrier, thereby entraining the second plurality of flat elements.

2. The method according to claim 1, wherein the upper side of the main stack carrier comprises a deposit table, and the moving step includes moving the deposit table relative to a remaining portion of the main stack carrier substantially opposite to the withdrawing direction of the auxiliary stack carrier.

3. The method according to claim 1, wherein the main stack carrier comprises an endlessly circulating conveyor belt, an upper portion of which forms at least partially the upper side of the main stack carrier, and wherein the moving step includes moving the endlessly circulating conveyor belt substantially opposite to the withdrawing direction of the auxiliary stack carrier.

4. The method according to claim 1, wherein the moving step includes moving the entire main stack carrier substantially opposite to the withdrawing direction of the auxiliary stack carrier.

5. The method according to claim 1, wherein the moving step includes delaying movement of at least the upper side of the main stack carrier until after the auxiliary stack carrier has moved a predetermined distance during the withdrawing step.

6. The method according to claim 1, including placing a first moveable receiving element on the main stack carrier, prior to the step of stacking the first plurality of flat elements, to receive and transport the finished stack.

7. The method according to claim 1, including placing a second moveable receiving element on the main stack carrier, prior to or during the positioning step, to receive and transport a subsequent finished stack.

8. The method according to claim 1, wherein the moving step includes additionally moving at least the portion of the upper side of the main stack carrier substantially upwardly substantially simultaneously with the movement in the advancement direction.

9. The method according to claim 8, wherein the moving step includes moving substantially the entire main stack carrier substantially upwardly.

10. The method according to claim 8, wherein the additionally moving step includes upwardly moving at least the portion of the upper side of the main stack carrier until the upper side of the main stack carrier reaches substantially a level of an upper side of the auxiliary stack carrier.

11. The method according to claim 8, further comprising placing a moveable receiving element on the main stack carrier, prior to or during the positioning step, to receive and transport a subsequent finished stack, and wherein the additional moving step includes upwardly moving the moveable receiving element until an upper side of the receiving element reaches substantially a level of an upper side of the auxiliary stack carrier.

12. The method according to claim 1, further comprising:

between the stacking a first plurality of flat elements step and the inserting step, introducing at least one separating element in the stacking region between a top flat element of the finished stack and a bottom flat element of a subsequent stack, above a level of the auxiliary stack carrier; and after the withdrawing step, removing the at least one separating element from the stacking region after the auxiliary stack carrier has been completely removed from the stacking region, wherein the separating element remains in the stacking region during the moving step.

13. The method according to claim 12, wherein the moving step comprises moving at least the portion of the upper side of the main stack carrier substantially horizontally relative to the second plurality of flat elements in a direction substantially opposite to the withdrawing direction of the auxiliary stack carrier at least until the at least one separating element has been removed from the stacking region.

14. The method according claim 12, wherein the moving step further comprises moving at least the portion of the upper side of the main stack carrier substantially upwardly substantially simultaneously with the substantially horizontal movement.

15. The method according to claim 1, further comprising:

lowering at least one of the main stack carrier and the auxiliary stack carrier in accordance with a rising height of at least one of the first and the second plurality of flat elements; and elevating the at least one of the main stack carrier and the auxiliary stack carrier in order to receive a subsequent plurality of flat elements.

16. The method according to claim 1, wherein each step is repeated at least once.

17. A device for forming stacks of flat elements in a stacking region, the flat elements being conveyed to the stacking region substantially continuously, the device comprising:

a main stack carrier defining an upper side arranged to receive a first plurality of flat elements thereon;

an auxiliary stack carrier arranged to be inserted into the stacking region upon achieving a finished stack containing a predetermined number of flat elements stacked on the main stack carrier in order to receive a second plurality of flat elements stacked thereon; and a controller adapted to control the movement of at least a portion of the upper side of the main stack carrier;

wherein the main stack carrier is further arranged to remove the finished stack from the stacking region and be positioned below the auxiliary stack carrier, and the auxiliary stack carrier is further arranged to be withdrawn from the stack region in a withdrawing direction to transfer the second plurality of flat elements from the auxiliary stack carrier onto the main stack carrier; and wherein at least the portion of the upper side of the main stack carrier is moveable in a substantially horizontal advancement direction that is substantially opposite to the withdrawing direction of the auxiliary stack carrier, and the controller is adapted to control the movement of the portion of the upper side of the main stack carrier in the advancement direction to entrain the second plurality of flat elements during withdrawing of the auxiliary stack carrier from the stack region.

18. The device according to claim 17, wherein the upper side of the main stack carrier comprises a deposit table adapted to be moveable relative to a remaining portion of the main stack carrier substantially opposite to the withdrawing direction of the auxiliary stack carrier.

19. The device according to claim 17, wherein the main stack carrier comprises an endlessly circulating conveyor belt, an upper portion of which forms at least partially the upper side of the main stack carrier, adapted to be movable substantially opposite to the withdrawing direction of the auxiliary stack carrier.

20. The device according to claim 17, wherein the entire main stack carrier is adapted to be moveable substantially opposite to the withdrawing direction of the auxiliary stack carrier.

21. The device according to claim 17, wherein the controller is adapted to delay the movement of at least the upper side of the main stack carrier until after the auxiliary stack carrier has moved a predetermined distance during the withdrawing step.

22. The device according to claim 17, further comprising a moveable receiving element arranged on the upper side of the main stack carrier, adapted to receive and transport the finished stack.

23. The device according to claim 17, wherein at least the upper side of the main stack carrier is adapted to be substantially upwardly moveable and the controller is adapted to control an upward movement of at least the upper side of the main stack carrier substantially upwardly substantially simultaneously with the movement in the advancement direction.

24. The device according to claim 23, wherein substantially the entire main stack carrier is mounted to be moveable substantially upwardly.

25. The device according to claim 23, wherein the controller is adapted to control the upward movement so as to upwardly move at least the upper side of the main stack carrier until the upper side of the main stack carrier reaches substantially a level of an upper side of the auxiliary stack carrier.

26. The device according to claim 23, further comprising a moveable receiving element arranged on the upper side of the main stack carrier, adapted to receive and transport the finished stack, wherein the controller is adapted to control the upward movement to upwardly move the moveable receiving element until an upper side of the receiving element reaches substantially a level of an upper side of the auxiliary stack carrier.

27. The device according to claim 17, further comprising at least one separating element adapted to be introduced in the stacking region between a top flat element of the finished stack and a bottom flat element of a subsequent stack, above the level of the auxiliary stack carrier after achieving the finished stack, the at least one separating element being further adapted to be removed from the stacking region after the auxiliary stack carrier has been completely removed from the stacking region, wherein the controller is adapted to control the horizontal movement such that the main stack carrier performs a movement substantially opposite to the movement of the auxiliary stack carrier in the withdrawing direction while the separating element remains in the stacking region.

28. The device according to claim 27, wherein the controller is further adapted to control the horizontal movement such that at least the upper side of the main stack carrier moves substantially horizontally relative to the second plurality of flat elements in a direction substantially opposite to the withdrawing direction of the auxiliary stack carrier at least until the at least one separating element has been removed from the stacking region.

29. The device according to claim 17, further comprising a frame arranged to mount the main stack carrier thereon, the frame being adapted to move the main stack carrier upward and downward in a substantially vertical direction.

30. The device according to claim 17, wherein the controller is adapted to control the upward and downward movement of the main stack carrier such that the main stack carrier is lowered in accordance with a rising height of the first plurality of flat elements and raised after the finished stack is removed.

31. The device according to claim 17, further comprising a frame arranged to mount the auxiliary stack carrier thereon, the frame being adapted to move the auxiliary stack carrier upward and downward in a substantially vertical direction and allow the auxiliary stack carrier to be introduced into and withdrawn from the stacking region.

32. The device according to claim 31, wherein the controller is adapted to control the upward and downward movement of the auxiliary stack carrier such that the auxiliary stack carrier is lowered from a position in which the auxiliary stack carrier is introduced into the stacking region in accordance with a rising height of the second plurality of flat elements and is raised after being withdrawn from the stacking region.

33. The device according to claim 23, wherein the controller is adapted to control the horizontal and upward movements of at least the portion of the main stack carrier comprising at least partially the upper side such that the horizontal and upward movements occur substantially simultaneously.

34. The device according to claim 33, further comprising:

a first drive element arranged to drive at least the upper side of the main stack carrier in a direction substantially opposite to the withdrawing direction of the auxiliary stack carrier; and a second drive element arranged to drive at least the upper side of the main stack carrier substantially upward;

wherein the controller activates the first and second drive elements.

35. The device according to claim 33, wherein the controller comprises at least one sliding guide arranged to mechanically guide at least the upper side of the main stack carrier.

* * * * *